US009834743B2

(12) United States Patent
Naeini

(10) Patent No.: US 9,834,743 B2
(45) Date of Patent: Dec. 5, 2017

(54) REMOVING PETS URIN, ODOR AND MILDEW OUT OF HAND MADE RUGS

(71) Applicant: Seid Mehdi Naeini, New York, NY (US)

(72) Inventor: Seid Mehdi Naeini, New York, NY (US)

( * ) Notice: Subject to any disclaimer, the term of this patent is extended or adjusted under 35 U.S.C. 154(b) by 0 days.

(21) Appl. No.: 15/136,902

(22) Filed: Apr. 23, 2016

(65) Prior Publication Data

US 2017/0306271 A1 Oct. 26, 2017

(51) Int. Cl.

| | |
|---|---|
| ***C11D 11/00*** | (2006.01) |
| ***C11D 7/06*** | (2006.01) |
| ***C11D 7/10*** | (2006.01) |
| ***C11D 7/12*** | (2006.01) |
| ***C11D 7/26*** | (2006.01) |

(52) U.S. Cl.
CPC ..... *C11D 11/0017* (2013.01); *C11D 7/06* (2013.01); *C11D 7/10* (2013.01); *C11D 7/12* (2013.01); *C11D 7/265* (2013.01)

(58) Field of Classification Search
CPC ..... C11D 11/0017
See application file for complete search history.

(56) References Cited

U.S. PATENT DOCUMENTS

| | | | | |
|---|---|---|---|---|
| 6,120,555 | A * | 9/2000 | Scialla | C11D 3/046 510/303 |
| 6,228,132 | B1 * | 5/2001 | Prince | D06M 13/188 8/128.1 |
| 6,699,828 | B1 * | 3/2004 | de Buzzaccarini | C11D 3/0052 510/310 |
| 7,012,053 | B1 * | 3/2006 | Barnabas | C11D 3/221 510/101 |
| 7,041,630 | B1 * | 5/2006 | Trinh | C11D 3/0015 510/276 |
| 2002/0025295 | A1 * | 2/2002 | Kim | C04B 28/02 423/701 |
| 2003/0183253 | A1 * | 10/2003 | Cornelius | C02F 5/10 134/42 |
| 2004/0168260 | A1 * | 9/2004 | Taylor | C11D 3/3947 8/115.51 |
| 2007/0261176 | A1 * | 11/2007 | Stone | D06F 95/006 8/148 |

* cited by examiner

*Primary Examiner* — Nicole M Buie-Hatcher
*Assistant Examiner* — M. Reza Asdjodi
(74) *Attorney, Agent, or Firm* — Seid Mehdi Naeini

(57) ABSTRACT

This invention relates to isolating and removing mildew, harmful bacterial and pets urine out of handmade wool and silk rugs.

The invention consist of three procedures that describes each step of work, chemicals mixture and timing used to achieve the this process.

It saves handmade rugs from being discarded, it describes a new safe and healthy approach in cleaning handmade rugs.

3 Claims, 5 Drawing Sheets

Silk rug after soaking and washing is being rinse with water

Figure 1:
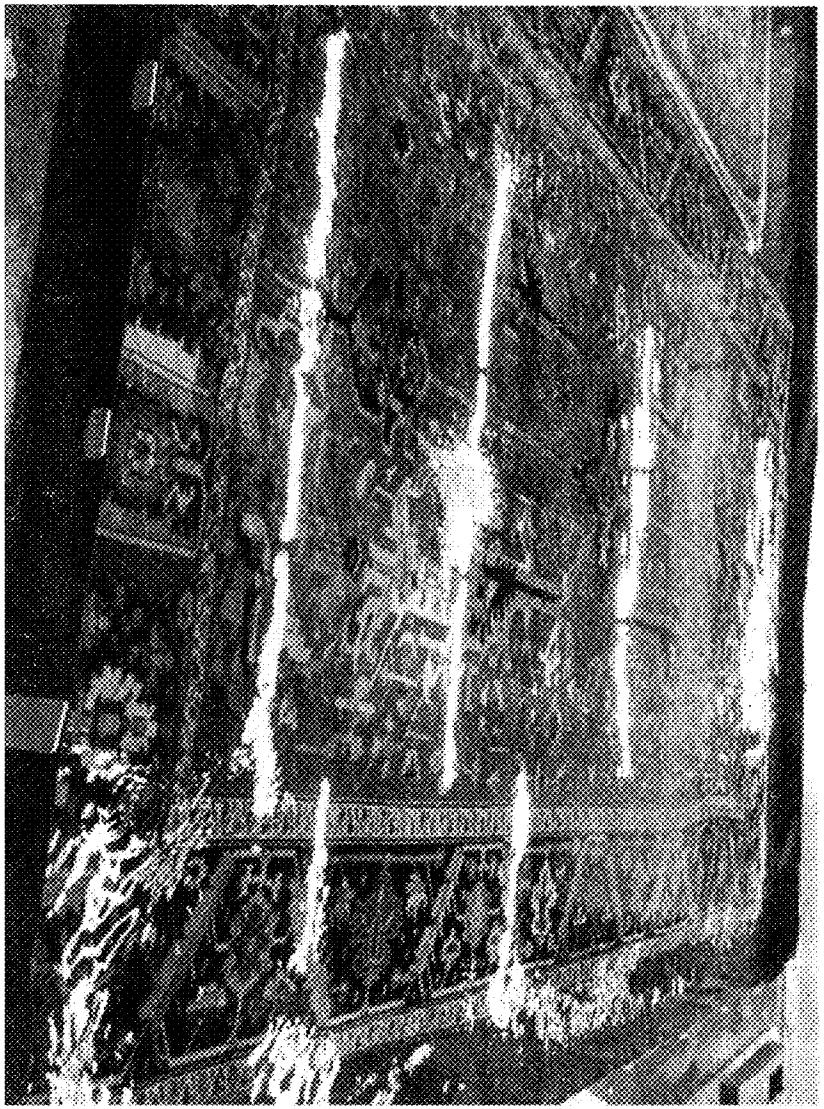

Figure 1 –soaking tank

Water is circulating above surface of the rug

After solution drained from the tank wash the rug.

When cleaning finished, Place the rug flat on wooden platform to dry

Soaking tank with rugs in the solution

Silk rug after soaking and washing is being rinse with water

REMOVING PETS URIN, ODOR AND MILDEW OUT OF HAND MADE RUGS

BENEFITS OF THIS INVENTION

This invention has made if possible to create new services and jobs. It eliminates handmade rugs from rotting, from being discarded and helps to create a more healthy environment. it allows the rug cleaning industry to grow.

SUMMARY

This document covers the process necessary to remove pet urine, odor, and mildew from wool and silk handmade area rugs.

The process and three procedures suggested here are highly technical and intended for rug experts and expert cleaners. It will save valuable area rugs from being discard, and give them a new life.

Procedure one—for fiber penetration of wool handmade rugs, it applies when the urine or mildew organisms are penetrated into the fiber, using sodium hydrochloride mixed with sodium hydroxide.

Procedure two—no fiber penetration of wool and silk handmade rugs, it explains the use sodium tetra borate and sodium bicarbonate.

Procedure three—no fiber penetration removing odor from handmade silk rugs using acetic acid.

SPECIFICATIONS AND TECHNICAL DATA

Procedure One—Technical Specifications:

Room temperature water.

Materials to work on: Handmade rugs, wool pile cotton foundation.

Active ingredients:

sodium hydrochloride, sodium hydroxide use one gallon of household bleach containing 6 to 8% sodium hydrochloride and 0.5% sodium hydroxide mixture.

Container: Large pool with 6 to 8 inches of depth, larger than the size of the rug with 1000 gallons of water than the size of the rug, with 1000 gallons of water.

Soaking time: 60 minutes.

Procedure Two—Technical Specifications:

Materials to work on: Wool and silk pile, cotton foundation handmade rugs.

Active ingredients:

Four pounds of Sodium Bicarbonate powder.

Four pounds of sodium tetra borate powder.

Container: water tank larger than the size of the rug. with 1000 gallons of water.

Soaking time: 60 minutes.

Procedure Three-Technical Specifications:

Materials: and silk pile, cotton foundation, handmade rugs

Active ingredients:

4 gallons of 56% acetic acid.

Container: Tank with 1000 gallons of water.

Soaking time: 60 Minutes

If there is any increase in the strength of active ingredients, there must be a decrease in soaking time.

RESOURCES NEEDED FOR THIS WORK

Minimum two men.

Safe place to work

Sodium hydrochloride, sodium hydroxide. OR Liquid household bleach with 6 to 8% sodium hydrochloride and 0.5% sodium hydroxide Sodium tetra borate Sodium bicarbonate Acetic acid Water tank or sealed container larger than the size of the rug.

Water pump for circulating the water solution in the tank

Water hose, drain, concrete floor, washing machine, wringer machine, drying platform, and air blowers.

Safety equipment for working with very high and very low PH products.

Figure 2:
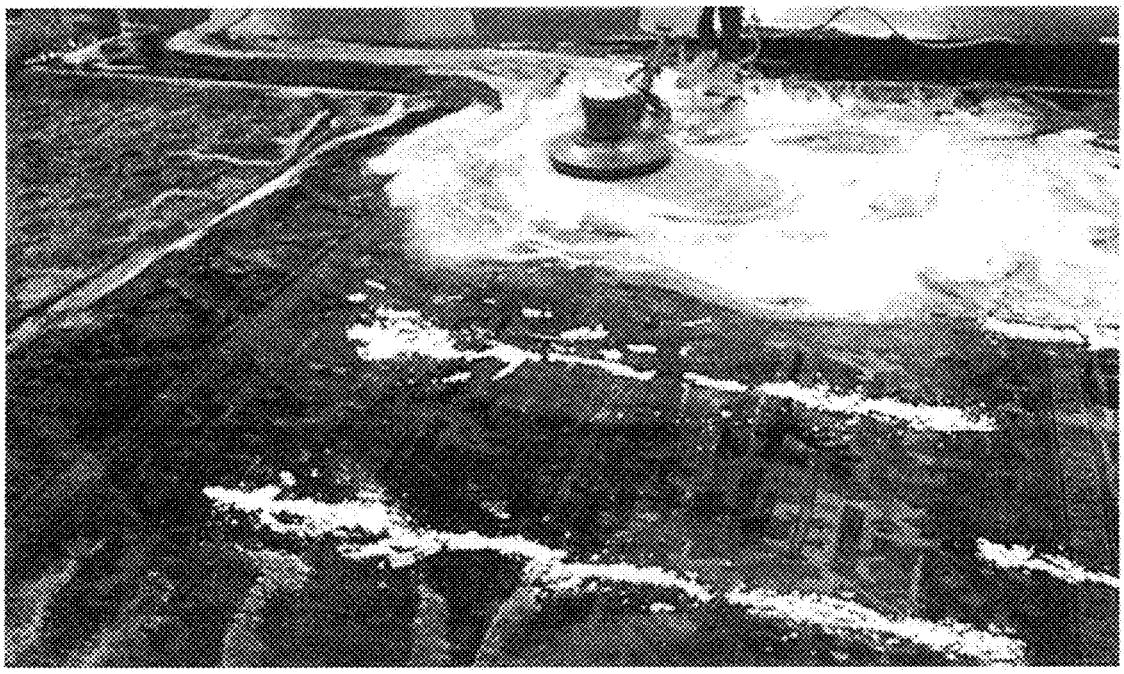
Figure 3:
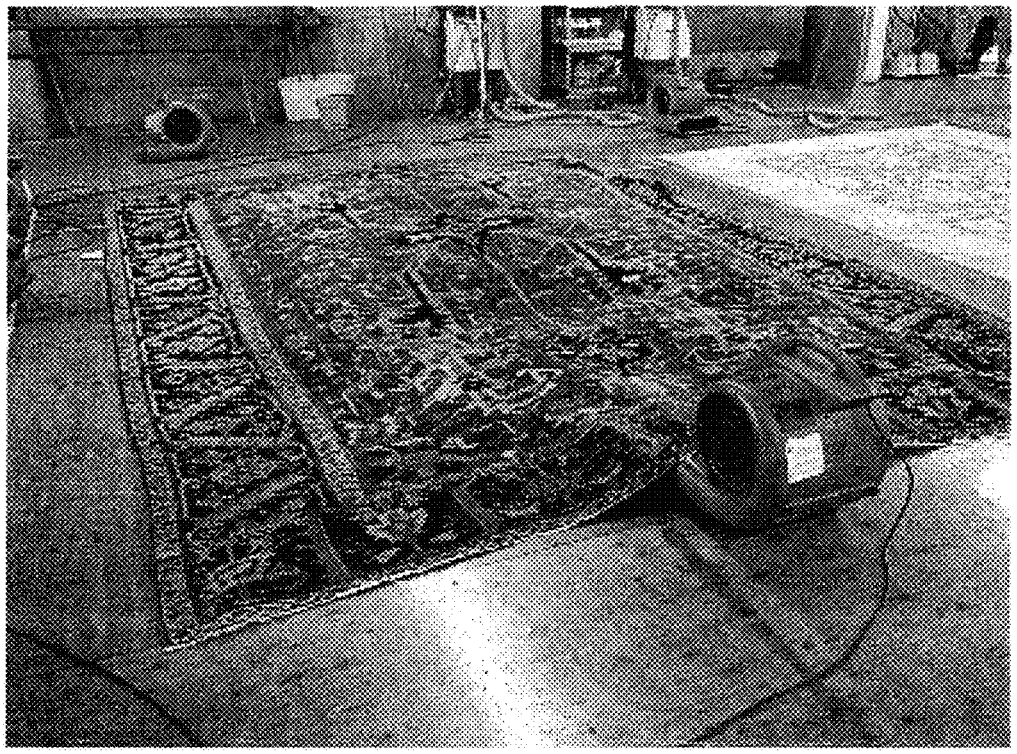

Procedure One—for Fiber Penetration (FIGS. 1,2,3)

Applies when the urine or mildew organisms are penetrated into the fiber.

Below we explain how to remove one or two microns from the fiber body.

- Place the rug in a sealed container, like a pool, about six inches deep. Lay the rug flat in the container with a capacity of 1000 gallons.
- Add water to the container tank, using room. temperature water, approximately two to three inches above the surface of the rug. Soak the rug with water for 20 minutes until dirt is dissolved in the water.
- Empty the tank until ALL dirty water is removed.
- Rinse the rug with water hose to help extra water DRAIN.
- Fill up the container tank again with water above Surface of the rug.
- Use circulating water pump to circulate the water over the rug.
- Add one gallon of household bleach containing 6 to 8% sodium hydrochloride and 0.5% sodium hydroxide to the circulating water tank with capacity of one thousand gallons of water.

DO NOT APPLY THIS LIQUID DIRECTLY OVER THE RUG.

- Circulate the liquid mixture over the rug for forty-five minutes to an hour.
- After maximum of one hour remove the liquid mixture from tank.
- Immediately after the mixture is drained wash the rug with rotary washing machine, detergent and water then rinse the rugs completely until all impurities, chemicals and detergents are out of the rug.
- Place the rug over flat wooden platform and use blower to dry.
- Do not use procedure one on rugs where moth have eaten the foundation. Rugs undergoing this process, must not have dry rot or deterioration.

Figure 4:
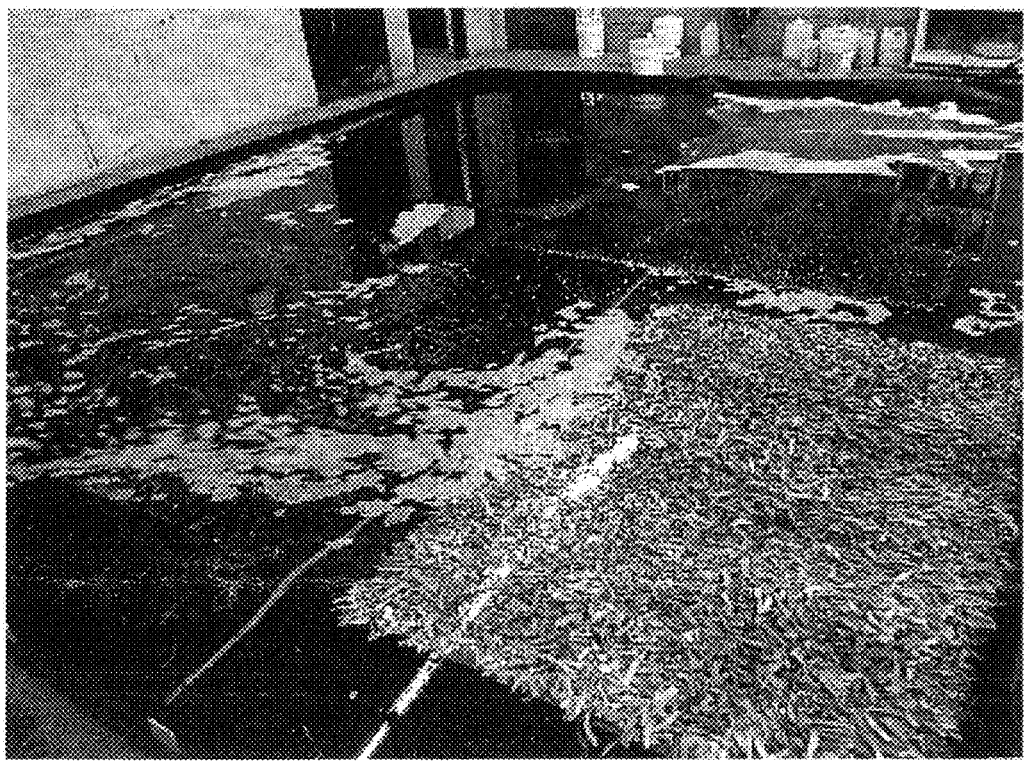

Procedure Two (FIG. 4)

For removing pet and smoke odor from silk and wool handmade rugs, where pet urine has not Penetrated into the fiber, use sodium bicarbonate and Sodium Tetra Borate.

- First place the rug face up in the tank as described and shown in Procedure One.
- Soak the rug for 20 minutes, and then empty the tank until dirt and pet urine residue is removed from the rug and the dirty water is completely out of the tank.
- Mix four pounds of sodium bicarbonate powder with four pounds of sodium Tetra Borate powder. Add this mixture to five gallons of water in a bucket, stir This mixture until all sodium bicarbonate and sodium Tetra borate is dissolved in the water.

Add this solution to the water tank as described in procedure One and circulate the water.

After one hour, empty the tank and then wash and rinse the rug as described in Procedure One.

Figure 5:
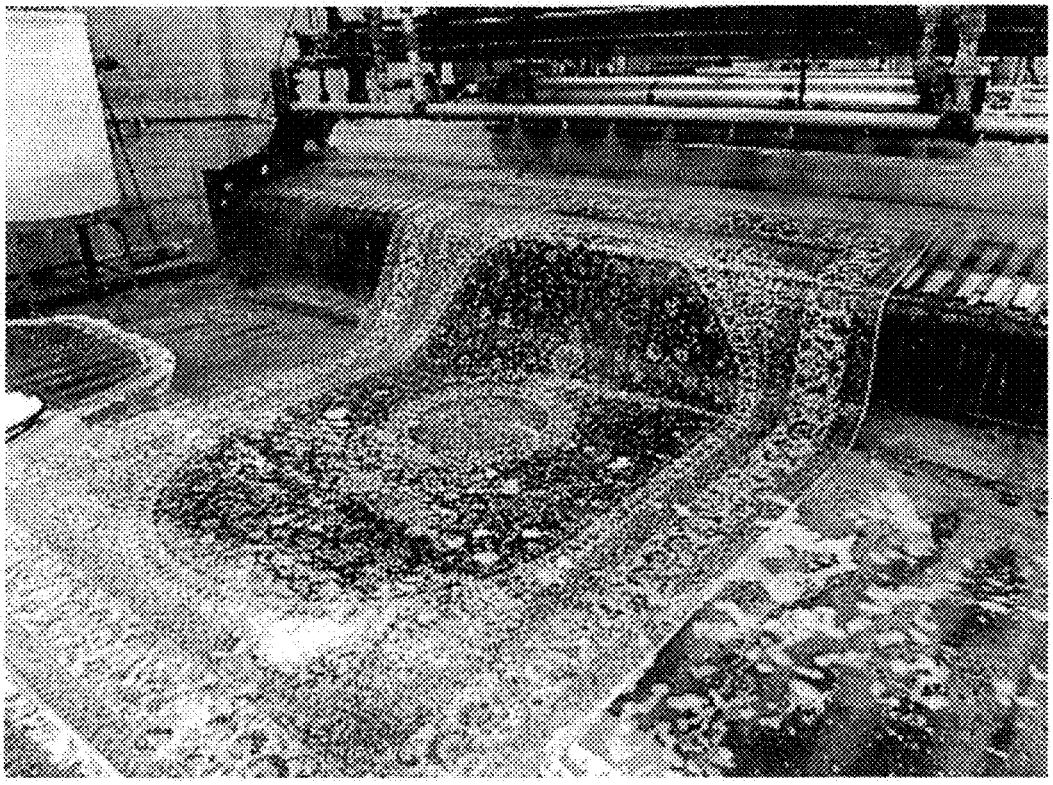

Procedure Three (FIG. 5)

Removing pet urine and odor from silk handmade rugs, when the urine has not penetrated into silk fiber. In this procedure we are using acetic acid.

Follow the first four steps explained In Procedure One.

Add 4 gallons of 56% acetic acid to the tank of 1000 Gallons OF water.

Circulate the water for one hour, then remove the rug, wash it as described in Procedure One.

End of process removing pets urine, mildew and odor from wool and silk handmade rugs

DRAWINGS DESCRIPTION

FIG. 1

ANTIQUE HANDMADE PERSIAN HARIZ RUG WITH WOOL FIBER, IN THE TANK OF SODIUM HYDROCHOLORIDE AND SODIUM HYDROXIDE SOLUTION, AS DESCRIBED IN THE PROCEDURE ONE,

FIG. 2

AFTER SOAKING DONE, THE RUG GETS WASHED AND SCRUBED, WITH WOOL DETERGENT AS DISCRIBED IN PROCEDURE ONE.

FIG. 3

AFTER SOAKING AND WASHING DONE, THE RUG IS SPREAD OVER PLATFORM TO GET DRY, AS DISCRIBED IN PROCEDURE ONE.

FIG. 4

SHOWS PET AND SMOKE ODOR FROM SILK AND WOOL HANDMADE RUGS, USING SODIUM BICARBONATE AND SODIUM TETRA BORATE

FIG. 5

REMOVING PET URINE AND ODOR FROM SILK HANDMADE RUGS, AS DICRIBED IN PROCEDURE THREE.

The invention claimed is:

1. A method of removing pet urine or mildew from handmade wool rug by applying a cleaning solution mixture comprising 8-12% of sodium hydrochloride and 0.5-6.5% sodium hydroxide to 850-1000 gallons of water for the wool rug and wherein the temperature of the solution mixture is between 50-95° F. which penetrates the wool rug for a duration of 45-60 minutes dissolving the mildew from infected areas of wool fiber thereby removing the pet urine or the mildew from the wool rug.

2. A method of removing pet urine or mildew from handmade silk rug by applying a removal solution mixture comprising 11-16% of sodium tetra borate and 11-16% of sodium bicarbonate to 850-1000 gallons of water for the silk rug; wherein the temperature of the removal solution is between 50-95° F. which penetrates the silk rug for a duration of 45-60 minutes dissolving the mildew or pet urine thereby removing the pet urine or the mildew from the silk rug.

3. A method of removing pet urine or mildew odor from handmade silk rug by applying a cleaning solution comprising 56% by volume of acetic acid to 850-1000 gallon of water and making the cleaning solution for said silk rug and wherein the temperature of the cleaning solution is between 50-95° F. which penetrates the silk rug for a duration of 45-60 minutes thereby removing the pet urine or the mildew from the silk rug.

* * * * *